US006065746A

United States Patent [19]

Tranquilla

[11] Patent Number: 6,065,746

[45] Date of Patent: May 23, 2000

[54] APPARATUS AND METHOD OF AUTOMATICALLY ADJUSTING A DOCUMENT DECELERATION RATE

[75] Inventor: Michael N. Tranquilla, Livonia, Mich.

[73] Assignee: Unisys Corporation, Blue Bell, Pa.

[21] Appl. No.: 09/035,537

[22] Filed: Feb. 17, 1998

Related U.S. Application Data

[60] Provisional application No. 60/038,098, Feb. 18, 1997.

[51] Int. Cl.[7] ..... B65H 43/00

[52] U.S. Cl. ..... 271/176; 271/265.01; 271/265.04; 271/177; 271/181; 271/182; 193/32

[58] Field of Search ..... 193/32, 40; 198/534; 271/265.01, 265.04, 176, 177, 181, 182, 270

[56] References Cited

U.S. PATENT DOCUMENTS

| | | | |
|---|---|---|---|
| 3,464,529 | 9/1969 | Hofsky | 193/32 |
| 3,489,258 | 1/1970 | Stokes | 193/32 |
| 3,918,701 | 11/1975 | Lee | 271/181 |
| 4,121,716 | 10/1978 | Luperti et al. | 209/564 |
| 4,223,751 | 9/1980 | Ayers et al. | 177/210 |
| 4,223,885 | 9/1980 | Templeton | 271/220 |
| 4,441,702 | 4/1984 | Nagel et al. | 271/177 |
| 4,453,870 | 6/1984 | Bean | 414/43 |
| 4,576,287 | 3/1986 | Bingham et al. | 209/601 |
| 4,591,145 | 5/1986 | Cherian | 271/258 |
| 4,640,505 | 2/1987 | Placke et al. | 271/177 |
| 4,789,149 | 12/1988 | Ray et al. | 271/181 |
| 4,864,124 | 9/1989 | Mirabella, Jr. et al. | 250/229 |
| 5,011,128 | 4/1991 | Tsuji | 271/263 |
| 5,062,622 | 11/1991 | Kataoka et al. | 271/270 |
| 5,145,165 | 9/1992 | Sarinopoulos et al. | 271/182 |
| 5,199,700 | 4/1993 | Fairey et al. | 271/177 |
| 5,415,387 | 5/1995 | Suzuki | 271/10 |
| 5,518,102 | 5/1996 | Hershline | 198/367 |
| 5,599,014 | 2/1997 | Kitahara et al. | 271/270 |

FOREIGN PATENT DOCUMENTS

| | | |
|---|---|---|
| 4-89736 | 3/1992 | Japan . |

*Primary Examiner*—H. Grant Skaggs
*Attorney, Agent, or Firm*—Rocco L. Adornato; Mark T. Starr; Lise A. Rode

[57] ABSTRACT

Apparatus and method for automatically adjusting a rate at which a document decelerates when entering a sort pocket of a document processing machine. The apparatus includes a track adapted for transporting the document, a guide wall, and a stacker flag spaced away from the guide wall to define the sort pocket therebetween. The sort pocket communicates with the track so that the document exits the track to enter the sort pocket. A wave spring is disposed proximate the guide wall so that the document engages the wave spring and is decelerated by the wave spring when the document enters the sort pocket. The weight of the document is calculated, and a signal is produced that represents the weight of the document. The wave spring is distorted according to this signal to vary a configuration of the wave spring depending on the weight of the document to decelerate the document at an optimal rate.

35 Claims, 13 Drawing Sheets

APPARATUS AND METHOD OF AUTOMATICALLY ADJUSTING A DOCUMENT DECELERATION RATE

This is a Continuation of my U.S. Provisional Application, U.S. Ser. No. 60/038,098, filed Feb. 18, 1997, and claims priority therefrom.

This involves document transport along a track with associated "smart gate" means for better diverting documents, and/or sensing diversion thereof.

BACKGROUND, FEATURES

Workers in the art of transporting documents along a track and reliably diverting them realize that there are certain difficulties that seem to persist. This case proposes a "smart gate" for such diversion and/or for sensing such.

Workers will recognize that high speed handling of documents (e.g., checks) is of increasing concern to banks today. A particular problem lies in how best to divert and decelerate or stop such documents transported along a track at high speed, where document-weight can vary considerably. Thus, a salient object hereof is to decelerate documents reliably, for a wide range of document weights and sizes, especially where inter-document spacing may be small, such as in high speed document transports and sorters.

A more particular object is to provide a "wave-spring" or like flexure that has a "bubble" and is controllably bent to offer increased deceleration to accommodate increasing document-weight, especially as sensed by document-detect means.

For instance, it is problematic to supply the exact document decelerating forces that are necessary for reliable document handling and stacking, e.g., to minimize damage to leading edges of documents as they are stopped and stacked in a sort pocket.

Workers realize that conventional document deceleration devices are tuned for average document size and weight. But many document processors, such as check sorters and postal sorters, for example, must deal with a variety of document sizes and weights. Consequently, lighter-weight documents are decelerated too much, too quickly, and therefore not likely to stack properly, e.g., with all their leading edges aligned. Misalignment of leading edges is often undesirable; e.g., giving problems in further machine processing (of a check-stack).

Heavier documents, on the other hand, are often not decelerated enough, or quickly enough. Consequently their leading edges can impact the back wall of a stacker pocket at high velocity; e.g., such as to damage the document or cause it to bounce back and not line up with other documents.

It is an object here to address such problems, and particularly to provide a document handling system that reliably and efficiently decelerates documents in a fairly constant fashion, despite (and relatively independent of) varying document size and weight—preferably doing so by detecting and computing document conditions prior to document deceleration, then adjusting deceleration parameters accordingly—i.e., using "smart" stop means.

Systems according to this invention are preferably designed to "tailor" document deceleration forces so that they are smaller for lighter documents and larger for heavier documents. This results in more uniform line-up of all documents regardless of size and weight. It also minimizes the impact velocity of larger, heavier, documents, so that damage to their leading edges is minimized.

Thus, a general object hereof is to address the here-mentioned problems, and provide advantages as suggested herein. A related object is to enhance the simple, reliable selective deceleration of checks and other documents in a deceleration-station, such as a sort-pocket.

A more particular object is to quickly, reliably selectively stop documents, despite high transport speed, despite close document spacing and despite varying document weight. A related object is to do so simply and inexpensively, with simple, inexpensive "spring-bubble" means. A particular object is to do this using weight-adjust means for maintaining a similar decelerate mode for both light and heavy documents—especially using a shape-adjustable, "bubbled" wave spring or other flexure with associated adjust means.

In sum, it is an object hereof to address at least some of the foregoing needs and to provide one or several of the foregoing, and other, solutions.

BRIEF DESCRIPTION OF THE DRAWINGS

These and other features and advantages of the present invention will be appreciated by workers as they become better understood by reference to the following detailed description of the present preferred embodiments which should be considered in conjunction with the accompanying drawings, wherein like reference symbols denote like elements:

FIG. 1A depicts a preferred selector-gate embodiment in the "open", diverting condition; while

FIG. 2 shows a wave-spring successively bent (-a thru -e) in various configurations, idealized, during document deceleration, while

FIG. 6 depicts an algorithm for this; while

DESCRIPTION OF PREFERRED EMBODIMENT

In giving details of the subject preferred embodiment, the methods and means discussed herein will generally be understood as constructed and operating as presently known in the art, except where otherwise specified; likewise all materials, methods, devices and apparatus described herein will be understood as implemented by known expedients according to present good practice.

Figure 1A:
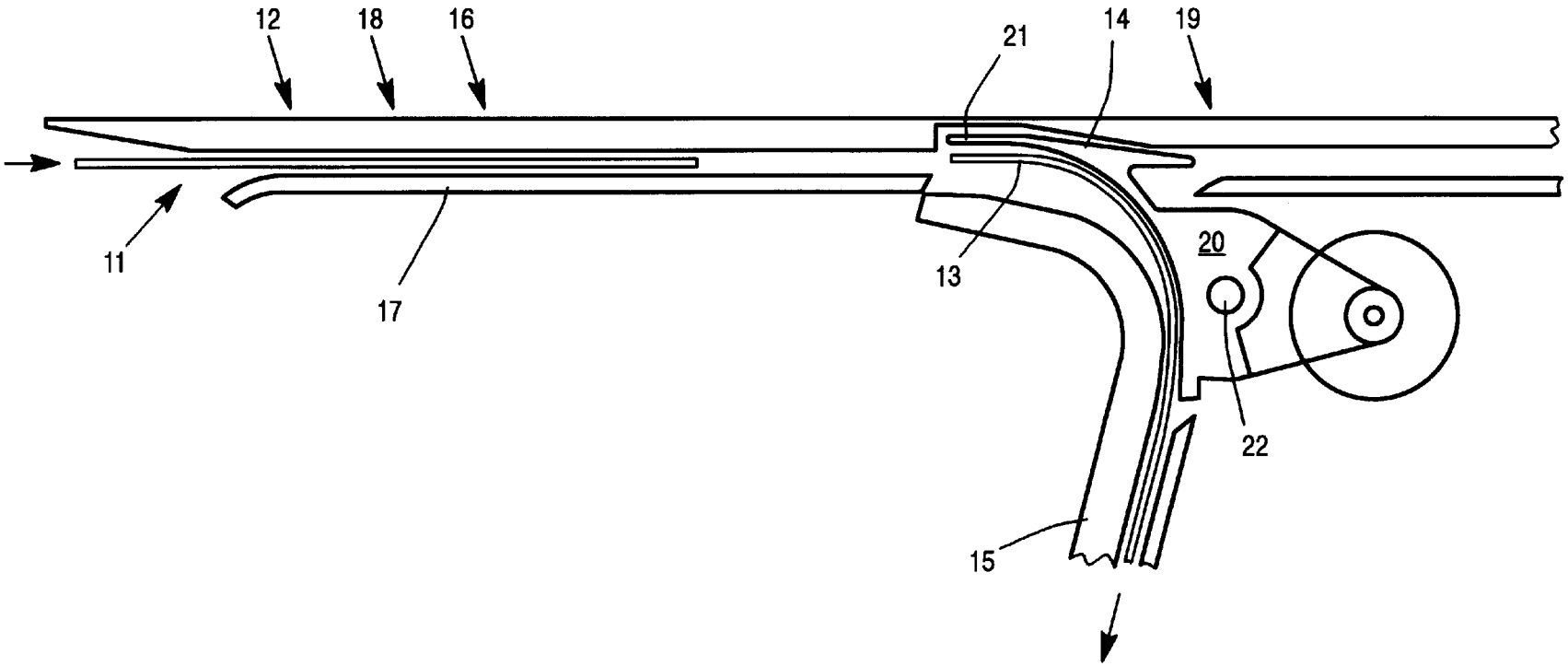
Figure 1B:
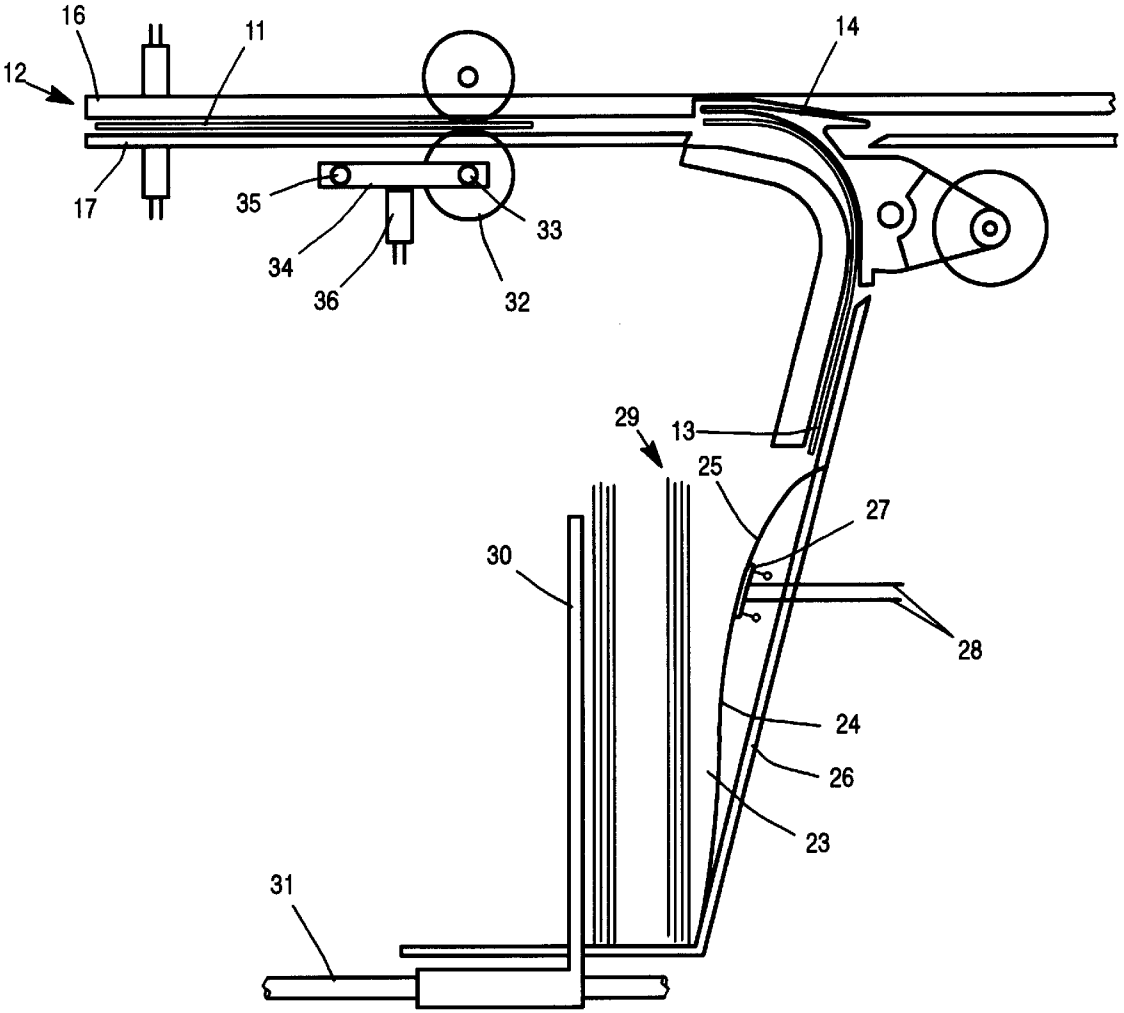
FIG. 1B shows the same with a sort-pocket added.

Sort-Pocket Embodiment-Introduction: FIGS. 1A, 1B:

Referring to FIG. 1A, documents 11 and 13 will be understood as transported down a track 12 to a common destination means (e.g., sort pocket) known to those familiar with the state of the art. This invention will work with any number of appropriate transport systems: rollers, vacuum belts, electrostatic belts, and other belts, etc., and combinations of these. Also, artisans will be aware of various means for tracking a document and detecting when it gets close to a specific selector gate which must be actuated to route the document along a desired path (none shown here).

An example of this is a "check sorter" which will read routing information printed on the check and then instruct various selector gates to actuate at the appropriate times to place the check in the desired pocket for pick-up and further processing. It is desired, as an object hereof, that these documents be reliably routed without jamming or being mis-routed with simple, inexpensive means, despite high transport speed and despite a wide range of document weights.

In FIG. 1A, a document 13 is shown applying pressure to a selector gate 14 while the gate is in its "open position", ready to divert the document (to track-segment 15, toward a sort pocket or to another transport for further processing). Here, assume that transport means (not shown) are conventionally driving documents along a track 12, defined, generally, between a pair of guide walls 16 and 17. A "following" document 11 may be close behind, where inter-document spacing is small and throughput is to be maximized. If the document 11 must go beyond selector gate 14 to another pocket or transport along track-segment 19 in-line with a entry track-segment 18 then selector gate 14 must perform its closing motion while the document 13 is trying to force it open. Such an "opening force" will be due to centrifugal and other forces as a result of the change in direction of a diverted document 13. Here, workers may assume that selector gate 14 comprises a body portion 20 projecting a blade portion 21; selectively, into the transport track 12 to divert a document down either track segment 15 or track track segment 18. Selector Gate 14 will be understood as selectively rotated, about pivot 22, for this.

For heavy documents, this opening force may retard the diverting motion of selector gate 14 sufficient that the selector gate 14 does not get out of the document guide track before the leading edge of the following document, 11, appears at the selector gate 14. If this happens, the following document 11 can jam at the gate, or be accidentally diverted along an unintended route.

DETAILS OF PREFERRED EMBODIMENTS

Referring to FIG. 1B, documents 11 and 13 will be understood as transported down track 12 by common means known to those familiar with the state of the art. This invention will work with any number of transport systems: such as rollers, belts (vacuum belts, electrostatic belts, etc.), and combinations of these. As known to those familiar with the state of the art, various means are available for tracking the document and detecting when it gets close to a document diverter (stacker). An example of this is a check sorter which will read routing information printed on the check and then instruct various diverter gates to operate at the appropriate time to place the check in a desired pocket (i.e., stack it for pick-up and further processing). Workers want to stack such documents reliably, in proper alignment and without damage.

In FIG. 1-B, a document 13 will be understood as routed through a pocket selector gate 14, which can selectively divert the document to a sort pocket 23. Pocket selector gate 14 may be any one of several designs presently familiar to those practiced in the art of document sorters, and this invention is not limited to any particular selector gate structure.

Nor is any particular selector gate operation required. The invention will also be seen as useful for document handlers that do not sort documents, such as copiers, check verifying devices, postal readers, optical document scanners, etc.

FIG. 1B s hows the leading edge of document 13 about to impinge upon a decelerating "wave spring" 24, or like flexure with a "bubble" 25 attached at its ends to a pocket guide wall 26. Wave spring 24 preferably comprises a thin (approximately 0.005 inch thick), narrow flexure (approximately 0.5 inch wide flexible metal or plastic strip). It is constructed and assembled so as to present a (FIG. 2) and a relatively "blunt" impact-angle to the oncoming leading edge of a bubble 25 document entering a sort pocket. Blunt angle aa of wave spring 24 will be seen to help decelerate the document and bring it to a stop. An object of this invention is to facilitate this; by associating wave spring 24 with a piezoelectric material 27 bonded to the wave spring and activated to change the value of this blunt angle and so tailor the decelerating force to the size/weight of the oncoming document—as will be detailed later wires 28 couple the piezo electric material to an electrical driver.

Figure 2:
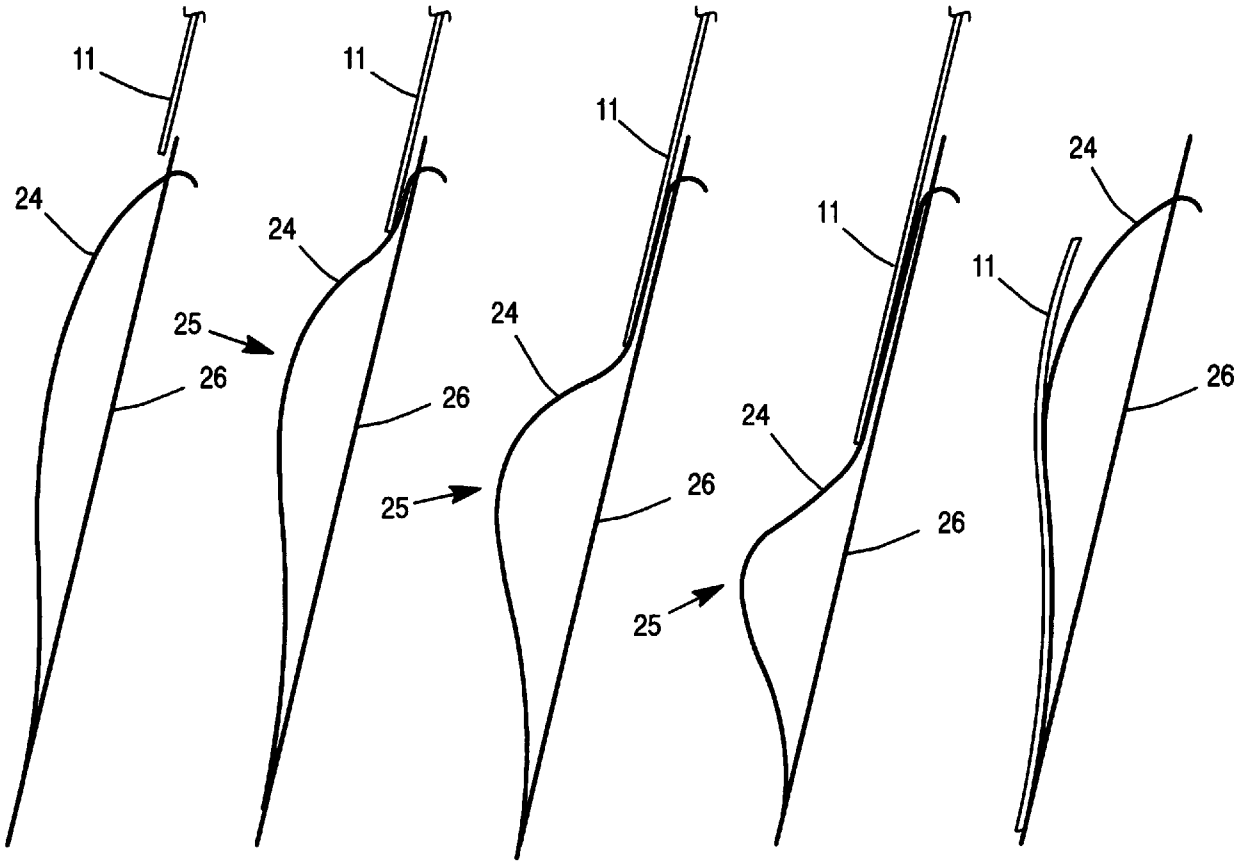

FIG. 2 shows a desired, idealized sequential decelerating action (2A thru 2E) of such a wave spring 24 as a document 11 moves along its length and is gradually decelerated. "Bubble" segment 25 (e.g., see 2B) will be understood as developing in wave spring 24 as document D-1 begins to engage wave spring 24. This "bubble" 25 is designed to precede the leading edge of the document 11; its function is to both maintain a proper blunt angle to the document and also to push-aside the previous document (e.g., to the left in FIG. 2) and prevent it from interfering with the following document (i.e., with the next document to be stacked). When a document leading edge has finished its travel along the length of the wave spring 24 (e.g., see FIG. 2-E), the bubble-segment 25 can then naturally return to its initial state (FIG. 2A). The technology for effecting this is well known to those familiar with the state of the art of document processors.

Returning to FIG. 1B, decelerated documents 29 will be understood as nudged to the left, by the action of wave spring, 24 against previously stacked documents, or against a stacker flag 30, in the case of the first document being stacked. Stacker flag 30 is guided to move left (or right) along a guide shaft 31 fixed to the base of the machine as workers appreciate. Stacker flag 30 may be driven by a motor in both directions to make room for additional documents to be stacked. It also may be driven by a motor in just one direction (usually to the left, here) to accommodate additional documents, and then returned to the right via return spring means, after documents are removed from the pocket. Such designs are well known to those familiar with the state of the art of document sorting, stacking and related processing. This invention will work with virtually any form of stacker flag or flag control.

Figure 3:
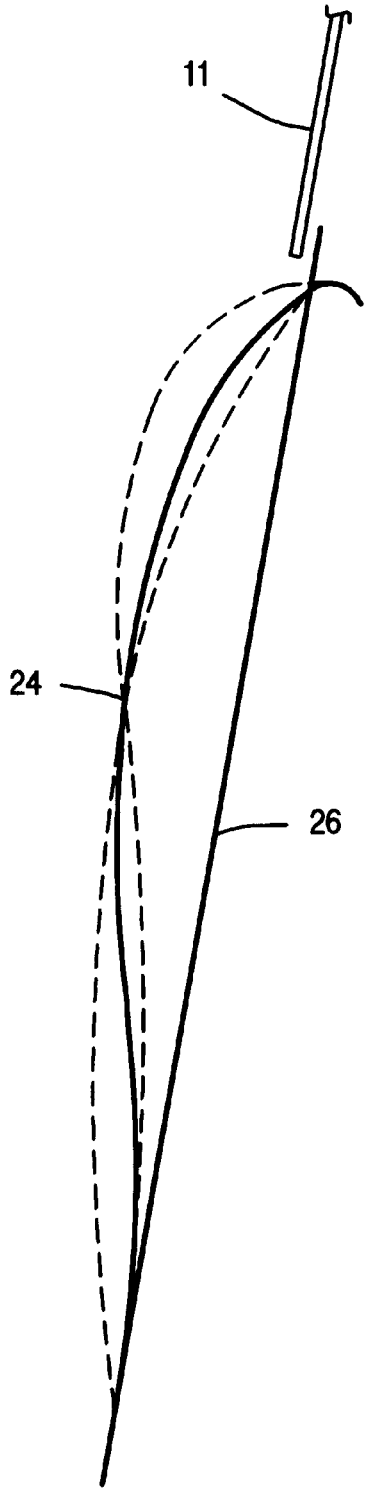
FIG. 3 shows various initial bent configurations that can be selectively produced by a piezo-polymer strip.

FIG. 1B also shows a length of piezoelectric material 27, such as a piezoelectric polymer that is bonded or otherwise attached to the wave spring 24 at a suitable point along the spring's length, and is adapted to stretch, or to contract, according to the polarity of voltage applied thereto, as known in the art. A preferred example of such a polymer is polyvinylidene fluoride. This polymer can be made very thin and lightweight so as not to deleteriously affect the normal operation of the wave spring. Thus, workers will understand that when piezoelectric 27 is polarized in the long dimension of the wave spring (e.g., to stretch under one polarity, and to contract under the reverse polarity—the amount depending on voltage amplitude); it can thus be made to change the initial distortion of the wave spring as shown in FIG. 3.

Operation:

Applying a first voltage $+V_1$ will be understood to produce a stretching, (amount depends on magnitude of V.) and associated tension, in the piezoelectric 27 and in the underlying section of wave spring 24. This results in a counter-clockwise torque in the section of the wave spring where the polymer is bonded, and increases the value of the blunt angle between an approaching document's leading edge and the wave spring, resulting in increased decelerating forces on the document.

Conversely, applying an opposite voltage-V across strip PP produces a compression or contracting of strip PP—and this results in a clockwise torque in the section of the wave spring where the polymer is bonded, and, in turn, decreases the value of this blunt angle (between the document's leading edge and the wave spring), thereby decreasing decelerating forces. In either case, varying the amount of the voltage will change the value of blunt angle, and hence, increase or decrease decelerating force.

Measure Document Size:

This invention also contemplates, preferably, an arrangement of elements that measure the size of the document and use this to adjust wave spring 24. Since most documents are made of paper, which has a fairly consistent weight density, a document's weight can often be determined, essentially, from its size: (i.e., its length, height, and thickness) without need for measurement.

The length of a document can also be measured, in a constant velocity transport, by many common means known to those familiar with the state of the art.

As stated above, the performance of the wave spring 24 can be made dependent upon the weight of an approaching document. This invention accounts for the weight of the document and adjusts wave spring shape accordingly.

Referring to FIG. 1-B the thickness TH of a document 11 can be measured when it forces a transport idler roller 32 to be displaced transverse to the direction of document transport (i.e., here normal to track 12, going left to right in FIGS. 1A, 1B).

Here, an idler roller shaft 33 is connected to an arm 34, which is pivoted about an arm pivot shaft 35 fixed to the transport frame—so that arm 34 will undergo angular displacement about its pivot shaft 35 when a document 11 engages idler 32. This arm motion is detected by an appropriate transducer 36 which converts an angular shift in arm position into an electrical signal. A thicker document will cause greater displacement—which, once detected can be converted to thickness values as workers know. Examples of such transducers are eddy current sensors, variable capacitance sensors, reflected light sensors, optical switches, etc., known to those familiar with the art of position detection.

Figure 4:
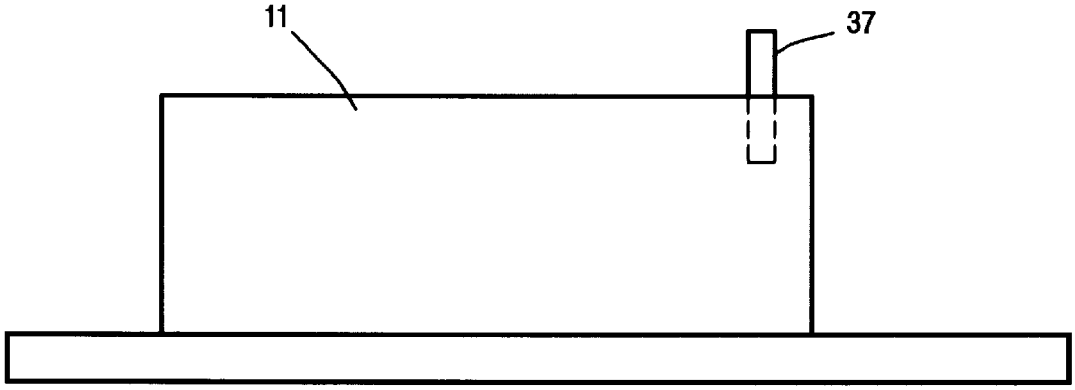
FIG. 4 shows a related height-detector.

Height-Measure:

Referring to FIG. 4, a photoelectric sensor 37, is located in a receiving cavity in the rear transport wall of transport track T; it is exposed to light from a light source in a like cavity in the opposing front transport wall (not shown). The electrical output signal from this sensor 37 can be made proportional to the total amount of light falling on its surface, as is commonly known by those familiar with the photoelectric sensors (sometimes called solar cells).

As shown in FIG. 4, a document 11 moving along track 14 will be understood to partially cover the photoelectric sensor 37 blocking some of the light from source from falling on the surface of 37, with "higher" documents blocking more light. This causes an electrical output signal sensor 37 from, whose amplitude depends upon document height—this output signal can be used (e.g., standardized) to indicate absolute document height, as workers will realize.

Figure 5:
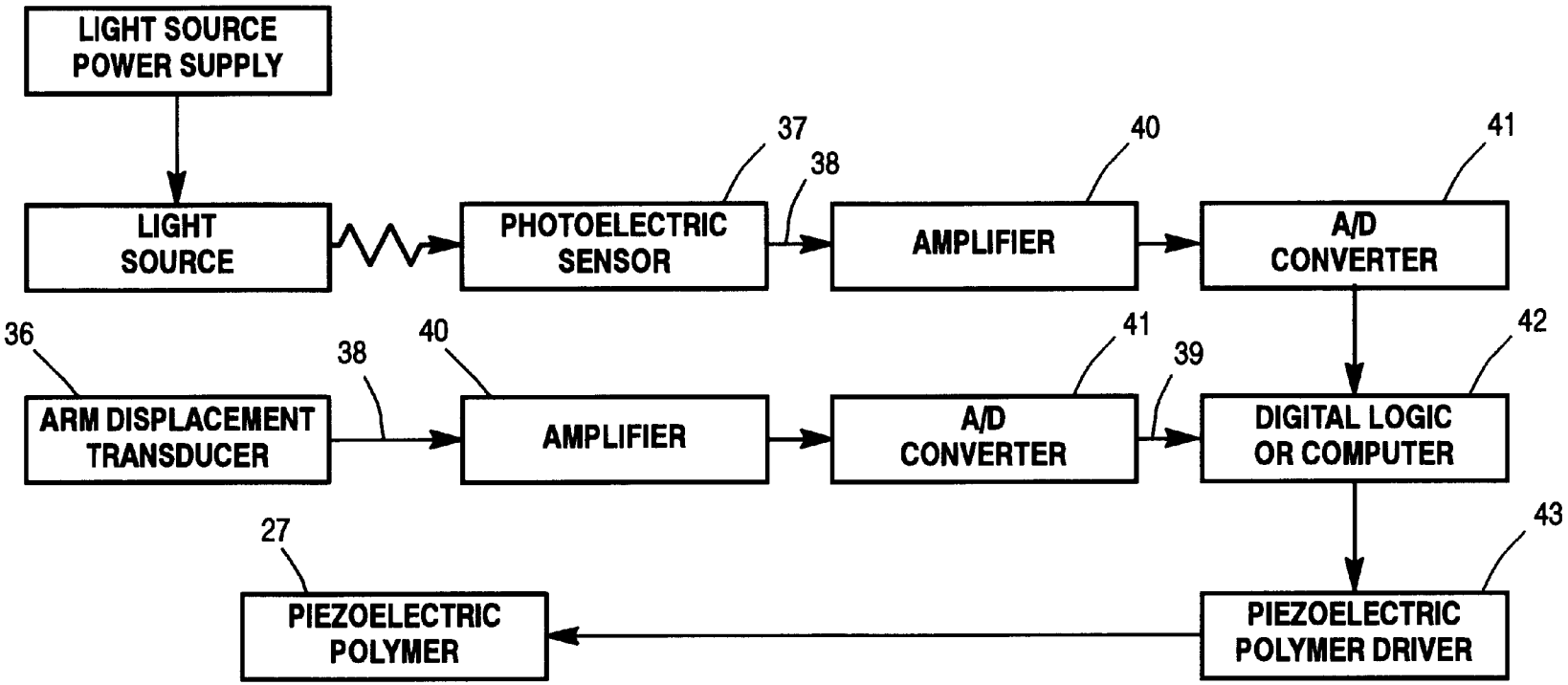
FIG. 5 shows a system for detecting document characteristics and responsively producing a suitable wave-spring shape.

FIG. 5 is a block diagram example of a preferred electrical circuit for use in this system. The electrical analog signal 18 from the photoelectric sensor 37 s and the transducer 36 (t-h) will be understood as amplified and converted to digital signals 39 by associated amplifiers 40 and analog-to-digital converters 41 which are commonly known in the art. These digital signals 39, along with digital signals from commonly known means for detecting passage of a document's leading edge and trailing edge (not shown), are stored and manipulated by a digital logic circuit or a computer, such as microprocessor 42. After proper manipulation of this information, the micro-processor 42 sends suitable electrical signals to the driver 43 for piezoelectric material 27, to direct piezoelectric material 27 to stretch, or to contract, by a suitable amount as appropriate.

Figure 6:
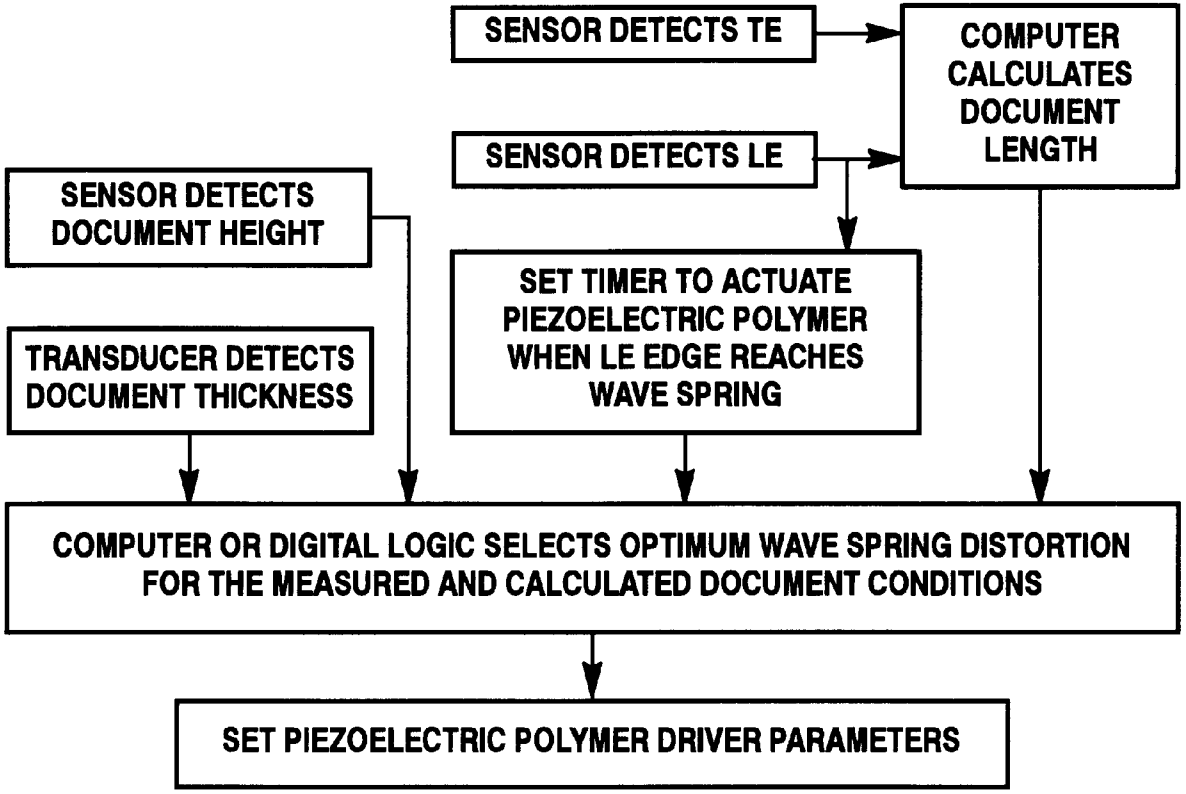

FIG. 6 illustrates a control algorithm for "smart actuation" of the selector gate 14. Using known information about the constant velocity of the document transport, the time-elapse $T_L$ between detecting a document's leading edge (LE) and trailing edge (TE) can be used to compute document length (as known in the art). This, together with document height ht and thickness t-h measurements, and with assumed paper density, permits machine calculation of document weight. Preferably, document velocity v is also determined (as known in the art) and input as well. The computer can then instruct the piezoelectric polymer driver 43 to accordingly adjust the blunt angle aa of wave spring 24—e.g., increasing it to decelerate a large, heavier document, or conversely, decreasing it (to produce a smaller blunt angle) to decelerate a lighter document. A worker should expect this to produce roughly the same deceleration (decelerating distance) for a wide range of document sizes and weights, and to also more fully arrest heavier documents and so prevent leading edge damage by minimizing impact against the front wall of the pocket.

This invention has application beyond check-handlers and like; e.g., for diverting and stopping documents in check-verifiers, postal processors, document sorters, scanners (e.g., optical), copiers, etc.

Alternative Spring-Distorter (FIGS. 7A,–7C):

Workers will recognize that a piezoelectric strip like 27 above functions to, essentially, "distort" the shape of a "deceleration flexure" like wave-spring 24 or the like—using control means (e.g., ±piezo-voltage) to do so, responsive to detection of related document conditions, such as indicated weight, size and velocity).

Figure 7A:
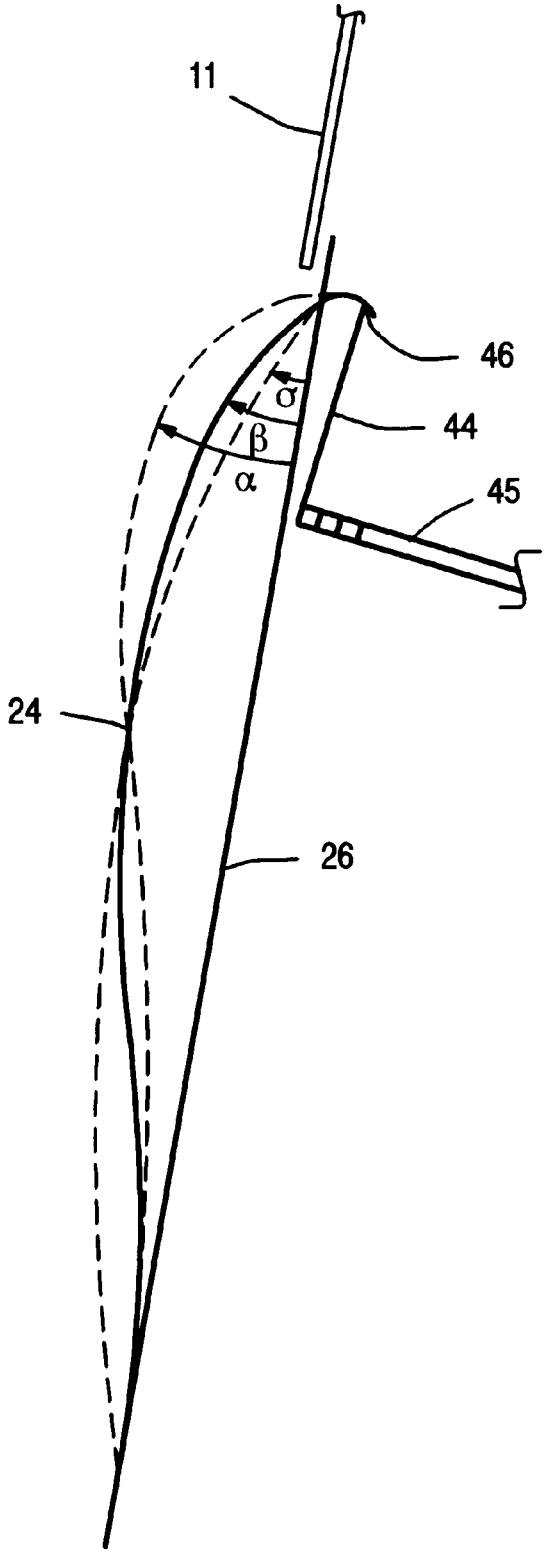
FIG. 7A shows an alternative to the piezo-polymer strip for bending a wave-spring.

Similarly, it should be appreciated that other similar-working "distorter means" can be substituted in many cases; for example, the motor-actuated lanyard 44 indicated in FIG. 7A. Here, as in FIG. 3, FIG. 7A shows wave-spring 24 in "first, second and third" states.

But, unlike FIGS. 1, 5, 6 where a piezoelectric material 27 is activated to so distort wave spring 24, here (FIG. 7A) a different, somewhat similar means—motor shaft 45 and attached lanyard 44—is substituted. That is, a lanyard 44 (e.g., light wire or plastic cable) is attached to wave spring 24 adjacent an upper, free end 44 thereof, with the other end of lanyard 44 attached, wrappingly, to be wound-up by a motor shaft 45 that is to be rotated, and so wind-up lanyard 44 and shorten its length, and thus pull the end of wave spring 24 down to increase the blunt angle aa thereof at its free end 46—as shown by the dashed-line configuration—in response to document condition signals, as with piezoelectric material 27. Conversely, lanyard 44 may be unwound "moderately" (as shown by the solid-line configuration) or maximally (as shown by the dotted-line). Thus, a motor and related controls (not shown but known in the art) will be understood as activated to rotate shaft 45 (e.g., of a know stepper-motor) a programmed amount (n degrees), and wind-up lanyard 44 sufficient to suitably increase the bend in wave spring 24 when a "heavier" etc. document approaches (e.g., with controls and systems analogous to those in FIGS. 5, 6—but adapted for this control-motor, etc., as known in the art).

Thus, the arrangement (LL, m-s, etc.) may preferably be understood as leaving 24 in the "least-bent" condition (dotted-line in FIG. 7A) for "min-weight" documents, while winding lanyard 44 and bending w-s more and more as document weight, etc., increases (thus, distorting w-s "moderately", to the illustrated solid-line condition for "moderate-weight" documents and maximally, to the dash-line condition, for maximum-weight documents).

Various techniques may be employed if a "return" is desired (e.g., of wave spring 24 to a "median-shape" such as per solid-line)—e.g., the motor may be controlled to do this after each document has been decelerated.

Figure 7B:
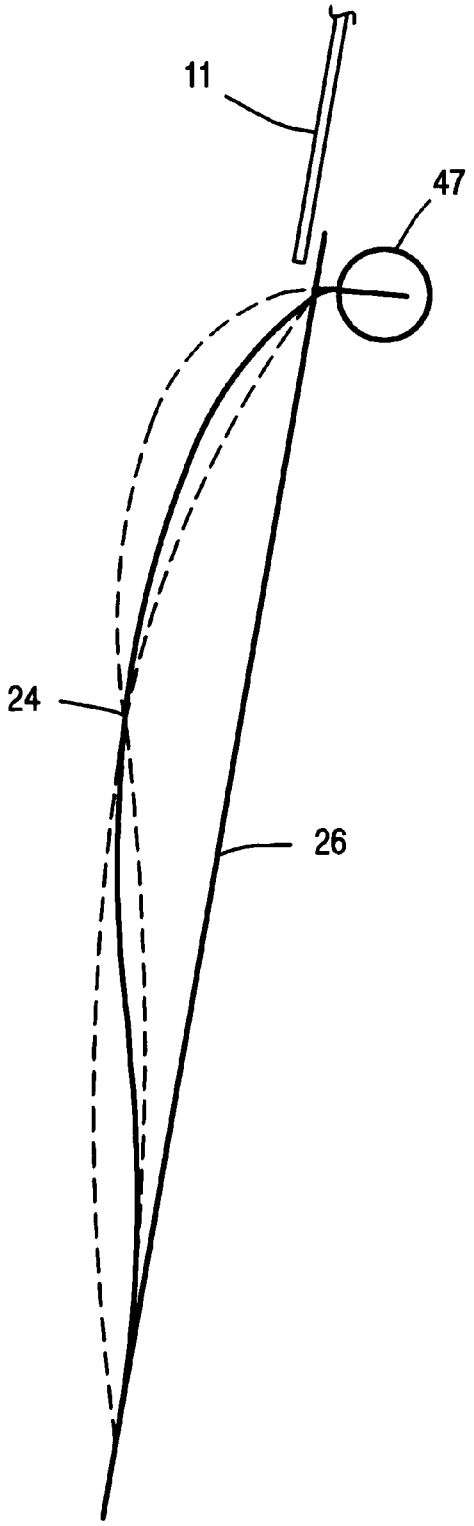
FIG. 7B shows the same with a rotatable shaft.

FIG. 7B is similar to FIG. 7A, but here the free end (tip) of wave spring 24 is attached to a shaft 47, adapted to be rotatably driven (preferably only a few degrees) up or down, as per arrow) by a motor (not shown; e.g., directly or via belt, pulley, gear etc., as understood in the art).

Here, the quiescent, rest condition of wave spring 24 is shown in solid-line (no shaft rotation), while the dash-line form is after counter-clockwise rotation of the shaft 47, and the dotted-line form is after clockwise shaft rotation.

Figure 7C:
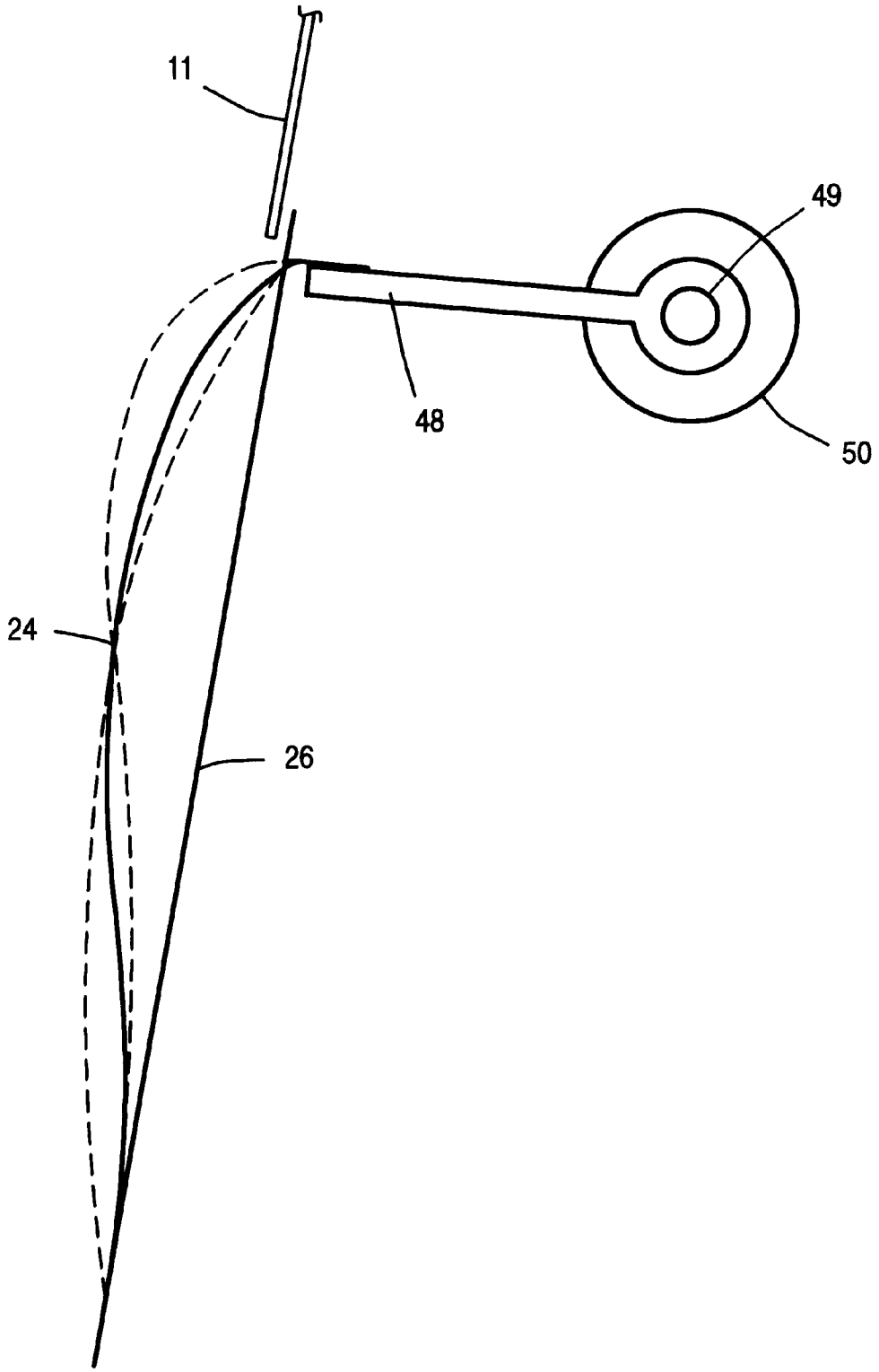
FIG. 7C shows the same using arm means.

FIG. 7C is similar to FIG. 7B, but here the tip of wave spring 24 is attached to a rigid arm 48 attached to, and rotated by an associated shaft 49 of a motor 50. As before, the REST condition of wave spring 24 is indicated as a solid-line, while the dashed-line indicates the result of downward, spring-compressing arm movement, and the dotted-line indicates the result of upward, spring-extending arm movement.

Workers will recognize that, where the embodiments in FIGS. 2,3 etc. must rely upon the wave spring 24 itself to return to REST condition (e.g., from condition in FIG. 2D back to that in FIG. 2A), the motor-actuated embodiments in FIGS. 7A–7C can readily be made to hasten such return using the motor with in FIG. 7C, arm 24 can be thrown "down to move wave spring 24 from REST, or solid-line condition to "more-compressed", or dashed-line condition, such as for receiving a heavier/faster document. Conversely, arm 45 can be thrown upward to move wave spring 24 contrariwise to a "more-tensioned" or dotted-line condition, such as for receiving a lighter/slower document.

Figure 8:
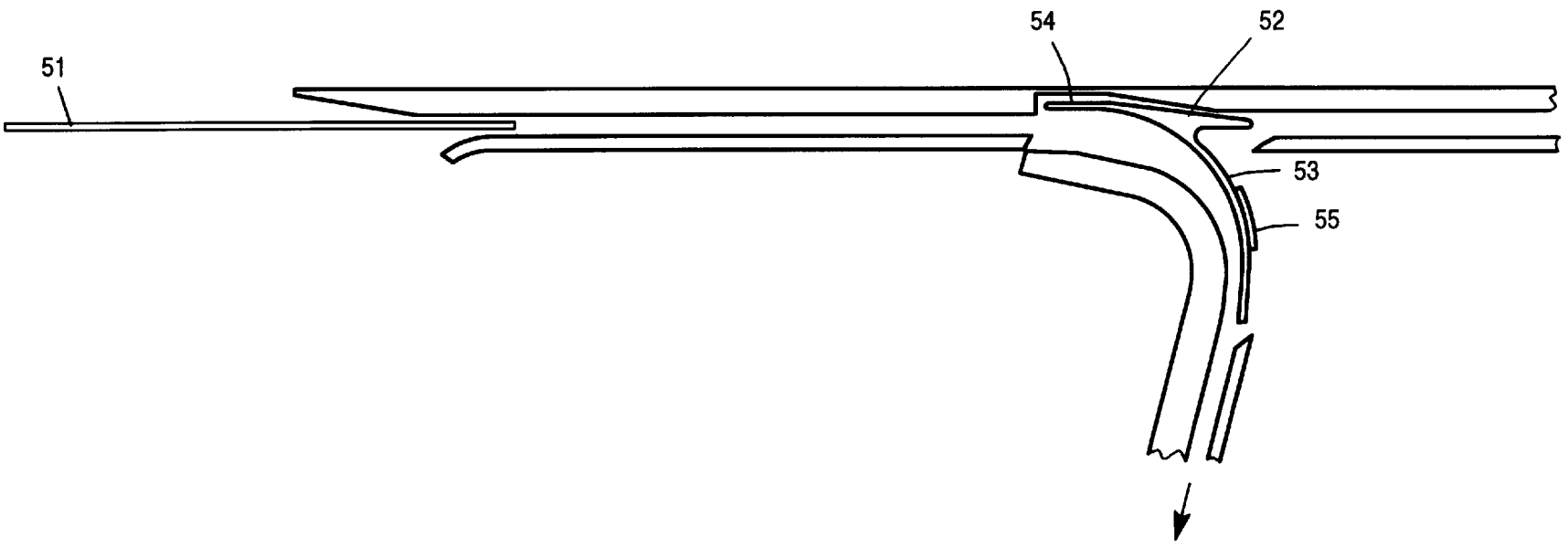
FIG. 8 is a modification of the array of FIG. 1A using a piezo-polymer strip.

FIG. 8 shows a modification of the document-transport/diverter array in FIGS. 1A, 1B (assumed the same except where specified otherwise) with a document 51 assumed to be transported along a main track 12, and to be selectively diverted by a diverter gate 52, to sort pocket, as before). However, here the diverter gate 52 is modified to comprise a spring flexure body 53, with a blade or tip 54 to be selectively thrust across the main track divertingly when spring flexure body 53 is properly compressed by a piezo-strip 55 bonded to spring flexure body 53 such as a thin, flexible segment of spring flexure body 53 that is fastened to a rigid frame, when piezo strip 55 is properly energized (as with piezo electric material 27 in FIG. 1B). Conversely, when block 54 is to be withdrawn from the main track (No-Divert condition), piezo strip 55 is oppositely energized to extend this flexure strip.

This piezo strip 55 is here employed to actuate a document diverter gate 52. If the piezoelectric strip 55 is powered to be in compression, the gate document diverter wants to open and divert document 51. Conversely, if it is powered to be in tension, the gate wants to close. Advantages are that this method of actuation is more compact, avoids sliding elements that can wear, and is potentially faster responding, since motor armature, pulley, and belt inertias do not need to be accelerated and decelerated.

Figure 9:
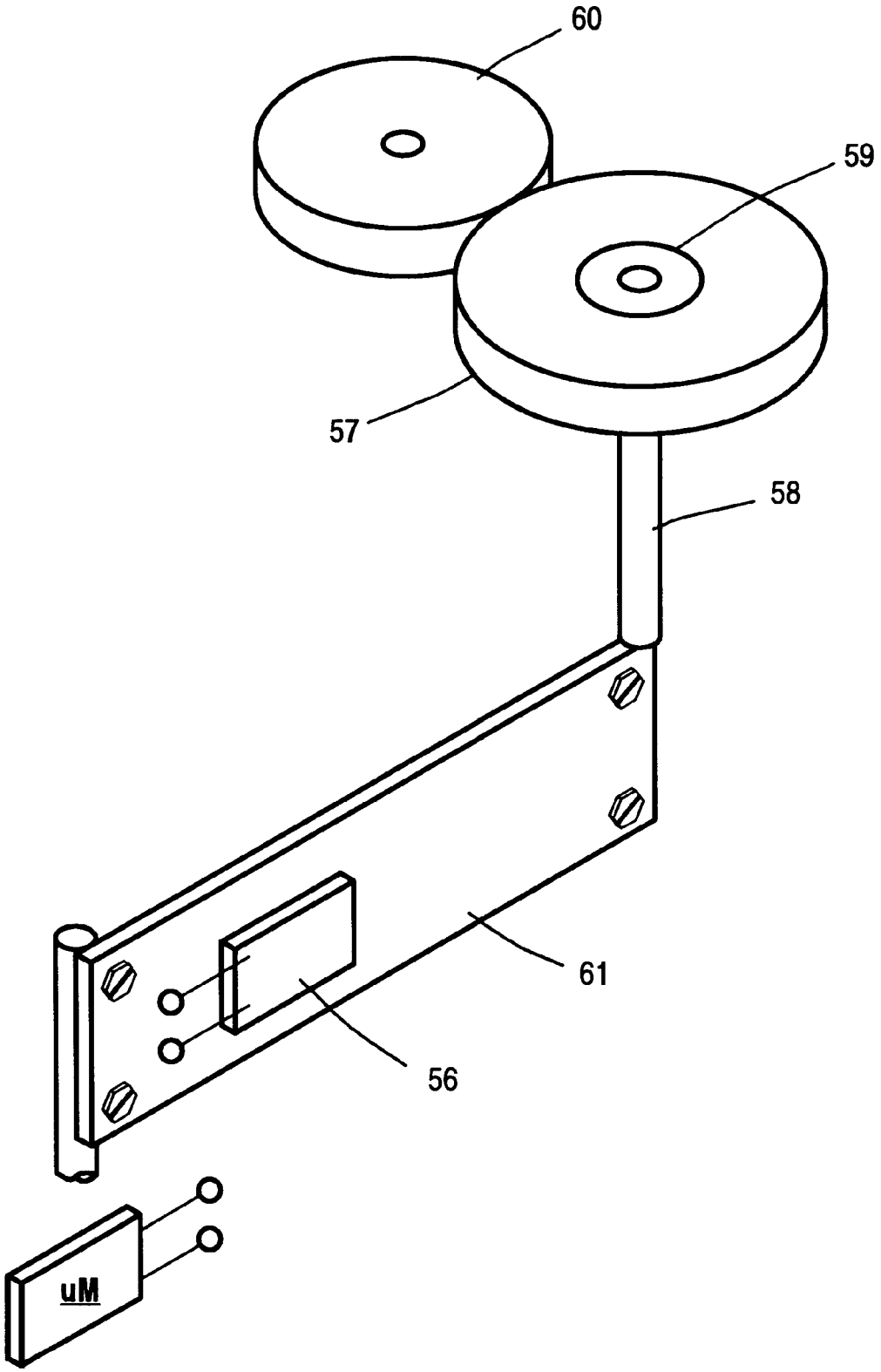
FIG. 9 shows how to use a like strip to position-adjust a pinch roller shaft.

Also, a piezo strip 56 polymer can be bonded to a flexure used in spring loaded pinch rollers 57 e.g., in FIG. 9. This can be used in place of a motor; advantages are the same for the above gate actuator.

An advantage of piezoelectric devices is that they can be turned-off quickly. Then for a short period of time (usually much less than the total actuation time), they can be used as a transducer to measure displacement or force since they can produce a voltage proportional to their distortion. If this measurement shows that insufficient displacement or force is being produced, they can be turned-on at a higher applied voltage level to make up for lost ground. Conversely, if there is too much displacement or force, less actuation can be used when they are turned back on.

Figure 10:
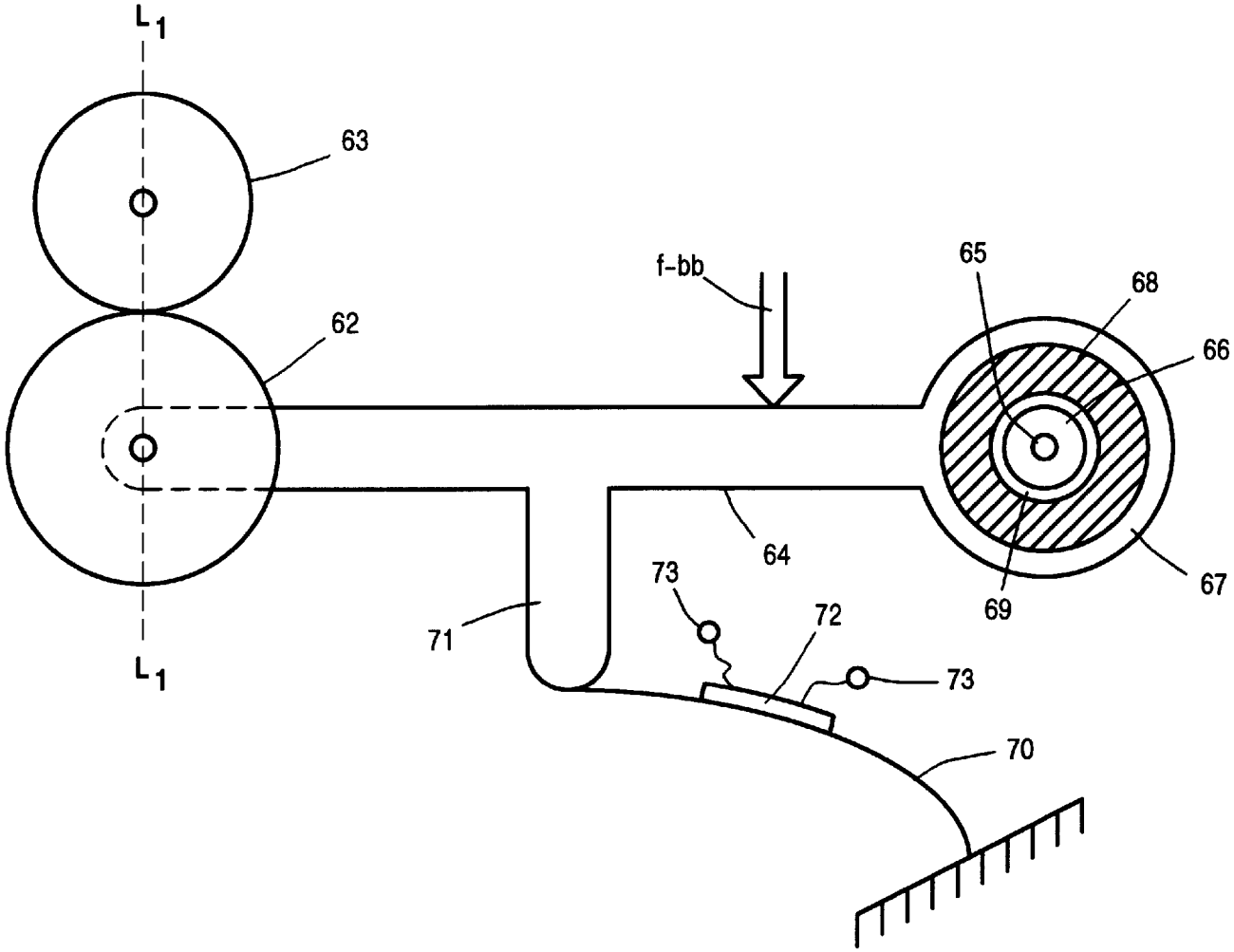
FIG. 10 shows how to use such a strip similarly and/or to sense such a position-shift.

This "feedback capability" of the piezoelectric polymer can be used as the means to provide damping for flexures (see FIG. 10). An advantage here is to be able to electrically select the amount of damping for different types of documents and transport speeds.

This feedback capability can also be used to sense that the force of a heavy document is slowing down the actuation of a diverter gate. Then, actuation forces could be increased, effectively making this a "smart gate".

This feedback capability can also be used to sense document thickness on a pinch-roll where the roll is mounted on an arm-flexure that includes a piezo strip, e.g., as in FIG. 10, also.

If a piezo flexure divert blade 54 (FIG. 8) is combined with a sort pocket spring like wave spring 24 in FIG. 1B, these would, of course, be two piezo-actuated flexures in use together.

Workers will understand that FIG. 9 shows a pair of transport rollers with the shaft 58 of one to be selectively rotated to move its roller 57, which may be configured as an idler on a ball bearing 59, such as drive roller 60, to close or open the inter roller nip relative to companion roller (drive roller R-1, e.g., to close, or open the interroller nip). For this, I show a flexure 61 fastened between shaft 58 and a fixed point, with a piezoelectric polymer strip 56 bonded to flexure 61 to provide a selectively-variable force to actuate shaft 58 and thus vary nip separation.

Imposing Sensing Flex-Stress (FIG. 10):

FIG. 10 depicts a moveable pinch roll 62 opposed by a fixed drive roll 63 which may be assumed as rotated about its center by any number of known contemporary means. Normally, a document (not shown) is moved to the nip between this roll pair 62 and 63 by known document feed means (e.g., another upstream roll assembly, not shown—e.g., in a high-speed check-sorter). And the document will be withdrawn from this roll assembly 62 and 63 to output means, such as another roll pair or to a stacker (neither shown, but well known in the art).

Moving Pinch roll 62, is cantilevered-out on an arm 64 which is free to pivot about a fixed end such as, on a shaft 65 usually with sealed ball bearings 66 to minimize friction and to prevent paper dust from accumulating in the bearing.

This fixed end of arm 64 comprises a flexible pivot assembly including a rigid hollow outer cylinder-end, 67 enclosing a resilient damping cylinder 68 (tube or sleeve which, in turn, surrounds a rigid hollow inner cylinder 69 mounted to rotate on fixed shaft 65. Damping sleeve 68 comprises flexible damping material bonded to outer cylinder 67, and to inner cylinder 69. Before operation of the transport, the inner cylinder 69 will be understood as free to rotate around fixed shaft 65.

A pre-load force Fp is preferably applied (and preferably along a line $L_1$—$L_1$ through the "nip", i.e., through pinch roll centers and the contact point between the two rolls. Line $L_1$—$L_1$ is perpendicular to a line $L_2$—$L_2$ between the moving roll's center of rotation and the pivot point of arm 64 (fixed shaft 5-1). But here, space constraints indicate that the preload is applied by a pre-load flexure f-b bearing against arm 64 via a detent 71 thereon. Flexure 70 includes a piezo-polymer strip 72 as above described.

That is, piezo-strip 72 may be energized (see electrode leads 73, FIG. 10) to urge arm 64 upward, biasingly vs down-force Fbb. And, where desired, piezo-strip 72 may alternatively be used as a passive bend-detect means, being arranged to output an electrical piezo-signal to indicate an increase/decrease in the bending stress on flexure 70, and further to quantify this—e.g., by way of using its piezo-output to indicate when, and by how much, a passing over-thick document makes the nip between rolls 62 and 63 to open, and thus electrically indicate document thickness, as workers will appreciate.

In like manner, piezo polymer strip 56 in FIG. 9 may be used to passively detect how much document thickness can force open the nip between rollers 60 and 57: i.e., how much 57 is moved thereby, with its shaft 58 causing flexure 61 to bend along with strip 56 bonded thereon to cause a responsive piezo-electric output reflecting this—e.g., at indicated electrode leads in FIG. 9 to utilization means UM, such as a thickness-indicating stage, as workers will realize.

In FIG. 10, so applying a preload on arm 64 prevents static loads from developing on the flexible damping material 68, which could induce "creep" thereof and degrade bias Fp over time.

Once a preload force is applied, the inner cylinder 59 is locked to fixed shaft 65, by any number of conventional means: set screw, clamp, bonding, welding, etc. When documents and/or protrusions thereon spread the rolls 21, 23 apart, arm 25 will be allowed to rotate about fixed shaft 65, but only via flexible material 68 (must twist or shear tube 68).

Preferably, this flexible material 68 is also "high damping", (e.g., as poly-urethane, certain rubber and other elastomers), so that tendency of the pinch rolls to "spread apart", open the "nip" and lose contact with a document (i.e., to move normal to the document transport direction) will be limited by this damping, resulting in the document remaining in more continuous, intimate contact with rolls 62 and 63.

Elastomer Tube (sleeve) 68 will thus preferably be torsionally-stressed when any over-thickness anomaly, such as a staple, enters the "nip" and will quickly urge the moveable roll 62 back toward the driving roll 63 once the anomaly passes the nip. Tube 68 should do this quickly, with constant force (no large return-force required) and without fatigue, degradation (e.g., overheating) or material failure, despite possible high-frequency service. Thus, Tube 68 should exhibit good torsional elasticity (e.g., over small, high-frequency excursions and minor loads—but no great radial elasticity required). Tube 68 should thus be "High-damping" to resist such high-frequency excursions and very quickly return the moveable roll 62 with little or no bounce—e.g., vs a lo-damping material that might tend more to "creep", or bounce or otherwise allow the nip to remain "open" or enlarged by an abnormal thickness discontinuity, and so allow the rolls to lose contact with a passing document. Preferred materials for Tube 68, like poly-urethane will be recognized as suitable by workers (e.g., such as also used for flat drive-belts or the like). In certain instances, a part-tube (e.g., 270° sector) may suffice.

Workers will appreciate the desirability of the pre-bias means, urging roll 62 vs drive roll 63; and understand that, preferably, elastomer Tube 68 should not provide this, since such a relatively large, continuous static load could induce undesirable "creep" in the tube and so degrade the bias Fp over time. Thus, Tube 11 works better in conjunction with a separate pre-bias means as indicated such as preloud flexure 70. The bias-flexure means 70 (e.g., leaf spring as known in the art) is to bear against a cooperating bias-detent projection 71 of arm 64 adapted to direct a bias force parallel to the nip-line $L_1$—$L_1$ between roll-centers as aforementioned.

Here, it will be recognized that piezo polymer strip 72 may be used passively, to sense contraction/tension in flexure 70, or actively to increase or decrease such (e.g., as in FIG. 8). Using piezo polymer strip 72 to sense contraction/tension in 70 can, in turn, provide a way of detecting overbias, or overstress on sleeve 68, as workers will appreciate—and a feedback signal from piezo polymer strip 72 can quantify this and responsively direct compensating means (as workers will appreciate).

Workers might hear in mind that the foregoing description places (assumes) piezo-strips (e.g., piezo electric material 27 in FIG. 1-B) on the "inner, concave" side of a given flexure (e.g., wave-spring 24 in FIG. 1-B) where the increased bending of the flexure will place it in increased compression, and will similarly further compress its piezo-strip. Such a piezo-strip could, in theory be affixed on the opposite, "outer, convex" side of the flexure (e.g., instead of, or in addition to, the strip depicted in FIG. 1-B—except that it would likely interfere with the smooth passage of incoming checks) where increased bending would place the flexure in increased tension, and would similarly further tension or stretch such a piezo strip thereon.

Alternative Uses:

Workers will recognize that, although these embodiments are described for use in a document sorter (especially for checks, etc.) a similar approach may be taken for use in other sorters such as mail sorters, or in other document handlers such as copiers, punch card transports, envelope stuffing machines, money feeders and other transports in automatic teller machines.

Workers will also recognize that the described approach to so activating and distorting a "smart stop" (wave-spring or like flexure) may be modified to nonetheless yield similar, advantageous results.

Workers will appreciate, from the foregoing, that I have taught a novel article-decelerating technique, preferably involving a stop-spring distorted selectively by means operated according to the expected document-impact, so that whether a document is minimum-weight or maximum-weight, and/or high-speed/low speed this will not significantly, adversely affect deceleration.

It will be understood that the preferred embodiments described herein are only exemplary, and that the invention is capable of many modifications and variations in construction, arrangement and use without departing from the spirit of the invention.

Since modifications of the invention are possible, for example, the means and methods disclosed herein may also be applicable to other article transport/diversion-deceleration modes and arrangements, especially using stop-springs (e.g., wave-springs) that are selectively controlled to present sufficient "bubble" or the like to optimize deceleration (e.g., some springs, such as a wire spring seem less suitable because they don't readily form such a "bubble" and/or they aren't readily adapted for use with a piezo-actuator or the like.

The above examples of possible variations of the present invention are merely illustrative. Accordingly, the present invention is to be considered as including all possible modifications and variations coming within the scope of the invention as defined by the appended claims.

What is claimed is:

1. In a method of decelerating items in a high-speed transport along a given path to be slowed at a given station therealong where contemplated variance in item-weight or speed could adversely affect deceleration mode, the steps of:

providing flexure-spring decelerate means fixed at a first end and presenting an opposed, absorber-end for impacting said items; and providing prescribed associated spring-distort means arranged and adapted to selectively distort said flexure-spring means in the shape of a bubble according to prescribed indicated item characteristics to provide the desired deceleration, said bubble moving down the length of said flexure-spring means during deceleration of said document, said spring-distort means having piezoelectric strip means fastened along said flexure-spring means and energized to impart tension or compression to said spring.

2. In a method of decelerating items in a high-speed transport along a given path to be slowed at a given station therealong where contemplated variance in item-weight or speed could adversely affect deceleration mode, the steps of:

providing flexure-spring decelerate means fixed at a first end and presenting an opposed, absorber-end segment in the path of a said item for impacting said item; and providing prescribed associated spring-distort means made up of a piezoelectric strip means fastened along said flexure-spring means and energized to impart tension or compression to said flexure-spring to adjust the angle of said absorber end-segment with respect to said item to provide the desired deceleration to said impacting item.

3. An item-decelerating arrangement at a decelerate-station disposed to engage and decelerate items thrust serially along a prescribed item-transport path; said arrangement comprising:

flexure-spring means comprising a thin strip of flexible material disposed to intercept items at said station and engage them to gradually decelerate them; plus spring-distort means made up of a piezoelectric strip means fastened along said spring means and energized to impart tension or compression to said spring means to selectively bend and reconfigure said spring means for developing an item-decelerating "bubble" that offers variable deceleration.

4. The arrangement of claim 3, wherein said "bubble" is made apt for impact by a said item, and apt for being moved down the length of said spring means by an impacting item at a decelerating rate.

5. A method of slowing items which are transported along a given path, at a prescribed decelerate-station, this method including the steps of:

providing elongate, flexible impact-spring means disposed at said station with one end fixed and the opposite impact end presented to impact each said item and to gradually slow it; plus spring distort means including at least one piezoelectric strip means engaged with said spring means and being selectively energizeable to change the shape of said spring means to increase or decrease its item-slowing ability.

6. The method of claim 5, wherein said spring means comprises flexure strip means and at least one said piezoelectric strip means is so attached on the "inner", concave side of said flexure strip means, so as to be further compressed when said flexure strip means is further bent.

7. The method of claim 6, wherein said distort means is arranged and adapted to selectively distort the decelerate-shape of said flexure-spring means according to prescribed indicated document characteristics, and so provide the desired deceleration.

8. A method of adjusting a rate at which a document is decelerated as it enters a sort pocket of a document processing machine, the method comprising the steps of:

calculating a weight of t he document;

generating a signal representing the weight;

disposing a wave spring in the sort pocket;

distorting the wave spring in response to the signal; and engaging the document with the wave spring to decelerate the document rate that is based on a physical configuration of the wave spring.

9. The method of claim 8, wherein the step of distorting includes altering a voltage applied across a piezoelectric material bonded to the wave spring.

10. The method of claim 8, wherein the step of distorting includes winding a lanyard around a motor shaft, the lanyard being connected to a free end of the wave spring.

11. The method of claim 8, wherein the step of distorting includes rotating a shaft joined to a free end of the wave spring.

12. The method of claim 8, wherein the step of distorting includes pivoting an arm that includes a first end joined to a motor shaft and a further end attached to a free end of the wave spring.

13. An apparatus for automatically adjusting a rate at which a document decelerates when entering a sort pocket of a document processing machine, the apparatus comprising:

a track adapted for transporting the document;

a guide wall;

a stacker flag spaced away from the guide wall to define the sort pocket therebetween, the sort pocket communicating with the track so that the document exits the track to enter the sort pocket;

a wave spring disposed proximate the guide wall so that the document engages the wave spring and is decelerated by the wave spring when the document enters the sort pocket;

means for calculating the weight of the document, the calculating means producing a signal representing the weight of the document; and means for distorting the wave spring, the distorting means being responsive to the signal from the calculating means to vary a configuration of the wave spring depending on the weight of the document.

14. The apparatus of claim 13, wherein the wave spring and the guide wall define an angle therebetween, and wherein the distorting means is adapted to alter the angle based on the weight of the document.

15. The apparatus of claim 14, wherein the distorting means is adapted to increase the angle for a relatively heavy document, and to decrease the angle for a relatively light document.

16. The apparatus of claim 13, wherein the distorting means includes a piezoelectric material bonded to the wave spring, the piezoelectric material being coupled to receive the signal from the calculating means and being adapted to alter the configuration of the wave spring in response to the signal.

17. The apparatus of claim 13, wherein the wave spring includes a free end, further comprising a lanyard and a motor shaft, the lanyard being joined between the motor shaft and the free end, the motor shaft being rotatable to adjust the configuration of the wave spring by winding the lanyard around the shaft.

18. The apparatus of claim 13, wherein the wave spring includes a free end, further comprising a shaft being rotatable, and wherein the free end is coupled directly to the shaft to alter the configuration of the wave spring by rotation of the shaft.

19. The apparatus of claim 13, further comprising a shaft that is rotatable and an arm coupled to the shaft, wherein the wave spring includes a free end, and wherein the free end is joined to the arm so that the configuration of the wave spring is controlled by rotation of the shaft.

20. The apparatus of claim 13, wherein the calculating means includes means for producing a thickness signal representing a thickness of the document, means for producing a height signal representing a height of the document, and means for computing the weight of the document based on the thickness signal and the height signal.

21. The apparatus of claim 20, wherein the thickness signal producing means includes a transducer, and wherein the height signal producing means includes a light source and a photoelectric sensor.

22. The apparatus of claim 13, further comprising a gate coupled between the track and the sort pocket to selectively divert the document from the track into the sort pocket, and further comprising a means for distorting the gate between a first position wherein the gate is disposed to divert the document from the track into the gate, and a second position wherein the gate is disposed to allow the document to remain in the track.

23. A method of adjusting a rate at which a document is decelerated as it enters a sort pocket of a document processing machine, the method comprising the steps of:

sensing one or more physical characteristics of said document prior to entry into said sort pocket, said sensors providing output signals representative of said sensed physical characteristics, disposing a wave spring in the sort pocket;

distorting the wave spring in response to said signals; and engaging the document with the wave spring to decelerate the document at a rate that is based on a physical configuration of the wave spring.

24. The method of claim 23 in which said one or more output signals provide an indication proportional to the weight of said document.

25. The method of claim 23 in which one of said output signals is sheet length.

26. The method of claim 23 in which one of said output signals is sheet width.

27. The method of claim 23 in which one of said output signals is sheet thickness.

28. The method of claim 23 in which said sensor outputs are used to determine the distance between sheets.

29. The method of claim 23 in which said output signals are said sheet length, width and thickness.

30. A method for adjusting the rate at which a document is decelerated as it enters a sort pocket of a document processing machine, comprising:

transporting said document along a track to said sort pocket;

sensing one or more physical characteristics of said document with sensors as said document is transported along said track, said sensors providing output signals representative of said sensed characteristics, disposing a wave spring in said sort pocket;

distorting the wave spring in response to said signals; and engaging the document with the wave spring to decelerate the document at a rate that is based on a physical configuration of the wave spring.

31. An apparatus for automatically adjusting a rate at which a document decelerates when entering a sort pocket of a document processing machine, the apparatus comprising:

a track adapted for transporting said document to a sort pocket;

one or more sensors disposed along said track, for sensing one or more physical characteristics of said passing documents, said sensors providing output signals representative of said sensed characteristics, a wave spring disposed in said sort pocket so that the document engages the wave spring when the document enters the sort pocket and is decelerated by the wave spring;

means for distorting the wave spring in response to said output signals to decelerate the document at a rate that is based on a physical configuration of the wave spring.

32. The apparatus of claim 31 wherein a computer receives said sensor output signals and provides a distortion signal, and also wherein said distorting means includes a piezoelectric material bonded to the wave spring, the piezoelectric material being coupled to receive the distortion signal from said computer and being adapted to alter the configuration of the wave spring in response to the distortion signal.

33. The apparatus of claim 31, wherein the wave spring includes a free end, further comprising a lanyard and a motor shaft, the lanyard being joined between the motor shaft and the free end, the motor shaft being rotatable to adjust the configuration of the wave spring by winding the lanyard around the shaft.

34. The apparatus of claim 31, wherein the wave spring includes a free end, further comprising a shaft being rotatable, and wherein the free end is coupled directly to the shaft to alter the configuration of the wave spring by rotation of the shaft.

35. The apparatus of claim 31, further comprising a shaft that is rotatable and an arm coupled to the shaft, wherein the wave spring includes a free end, and wherein the free end is joined to the arm so that the configuration of the wave spring is controlled by rotation of the shaft.

* * * * *